United States Patent [19]

Nakayama et al.

[11] 4,070,136

[45] Jan. 24, 1978

[54] APPARATUS FOR LUBRICATING A SWASH PLATE COMPRESSOR

[75] Inventors: Shozo Nakayama; Masayuki Kurahashi; Kimio Kato, all of Kariya, Japan

[73] Assignee: Kabushiki Kaisha Toyoda Jidoshokki Seisakusho, Japan

[21] Appl. No.: 661,305

[22] Filed: Feb. 25, 1976

Related U.S. Application Data

[63] Continuation of Ser. No. 465,268, April 29, 1974, Pat. No. 3,955,899.

[30] Foreign Application Priority Data

May 11, 1973 Japan ..... 48-55910

[51] Int. Cl.[2] ..... F04B 27/08

[52] U.S. Cl. ..... 417/269; 184/6.16; 184/6.17

[58] Field of Search ..... 417/269, 439; 184/6.17, 184/6.16

[56] References Cited

U.S. PATENT DOCUMENTS

| | | | |
|---|---|---|---|
| 3,712,759 | 1/1973 | Olson | 417/269 |
| 3,801,227 | 4/1974 | Nakayama | 417/269 |
| 3,838,942 | 10/1974 | Pokorny | 417/269 |
| 3,904,320 | 9/1975 | Kishi et al. | 417/269 |

*Primary Examiner*—William L. Freeh
*Assistant Examiner*—Edward Look
*Attorney, Agent, or Firm*—Burgess, Ryan and Wayne

[57] ABSTRACT

A multi-piston swash plate type compressor, in which there is provided an improved internal arrangement for lubricating internal moving elements, especially steel ball bearings and shoes connecting the swash plate and the multi-pistons. The improved internal arrangement for lubricating the steel ball bearings and shoes comprises providing means for directly introducing a part of said oil particles suspended in the refrigerant gas which rushes into the combined block from the exterior of the compressor through one or more inlet ports formed in the combined block, into a swash plate chamber for rotatably mounting the swash plate therein, whereby the oil particles lubricate said ball bearings and shoes during operation of the compressor. The improved internal arrangement further contributes to effective employment of the blow-by refrigerant gas for distribution of oil lubricant to the cylinder bores along with said internal moving elements.

2 Claims, 6 Drawing Figures

APPARATUS FOR LUBRICATING A SWASH PLATE COMPRESSOR

This a continuation, of application Ser. No. 465,268, filed Apr. 29, 1974 now Pat. No. 3,955,899.

The present invention relates to a swash plate type compressor and in particular, to a swash plate type compressor for use in air conditioning systems for vehicles.

U.S. Pat. No. 3,352,485 of Akira Niki et al and U.S. Pat. No. 3,1801,227 of Shozo Nakayama, disclose a multi-piston, double acting, single swash plate refrigerant gas compressor having a pair of horizontal axially aligned cylinder blocks forming a combined block.

The compressors of the type disclosed in the abovementioned Patent and Application are provided with an internal arrangement for distributing oil lubricant to movable parts or elements of such compressors, such as radial and thrust bearings and the pistons, so that the movable parts or elements are lubricated by the distributed oil lubricant during operation of the compressors. However, it has recently been found that these prior internal arrangements are incomplete, especially in lubricating steel ball bearings and shoes connecting the swash plate and the multi-pistons.

Therefore, the principal object of the present invention is to provide a general improvement for the internal lubricating arrangement of the prior type compressors wherein the internal lubricating arrangement is improved so as to prevent seizure of the moving elements of the compressor during long continuous operation.

Another object of the present invention is to improve the internal lubricating arrangement of the prior art compressor so as to be capable of directly supplying oil lubricant to the steel ball bearings and shoes connecting the swash plate and the multi-pistons of the compressor.

That is to say, in accordance with the present invention, for a swash plate type compressor, there is provided an improvement comprising means for directly introducing a part of said oil particles suspended in the refrigerant gas which rushes into the combined block and through one or more inlet ports formed in said combined block, into a swash plate chamber for rotatably mounting the swash plate therein.

In accordance with the present invention, there is provided a further improvement comprising means for permitting the blow-by refrigerant gas in the swash plate chamber to flow into the suction chamber of cylinder heads positioned at the ends of the combined block via the bottom oil chamber of the compressor, whereby, during operation of the compressor, the oil lubricant separated from the refrigerant gas is distributed by the blow-by gas to the cylinder bores and other moving elements which are required to be lubricated by the oil lubricant.

The present invention will be made more apparent in detail from the ensuing description, reference being made to the accompanying drawings wherein.

The drawings of FIGS. 1 through 5 show an embodiment of the present invention, which is an improvement over the compressor of the type disclosed in the abovementioned prior United States Patent Application.

Figure 1:
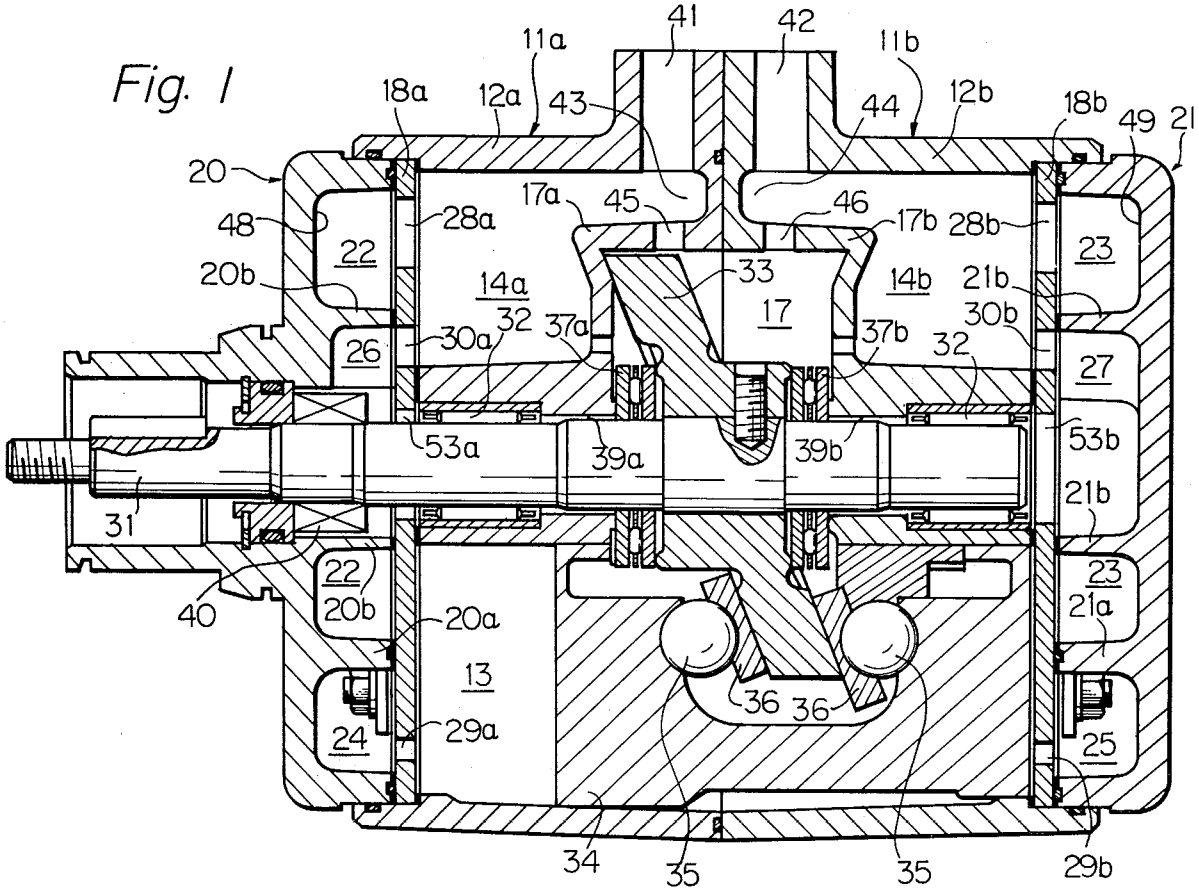
FIG.1 is a longitudinal cross sectional view of a swash plate type compressor according to one embodiment of the present invention.
Figure 2:
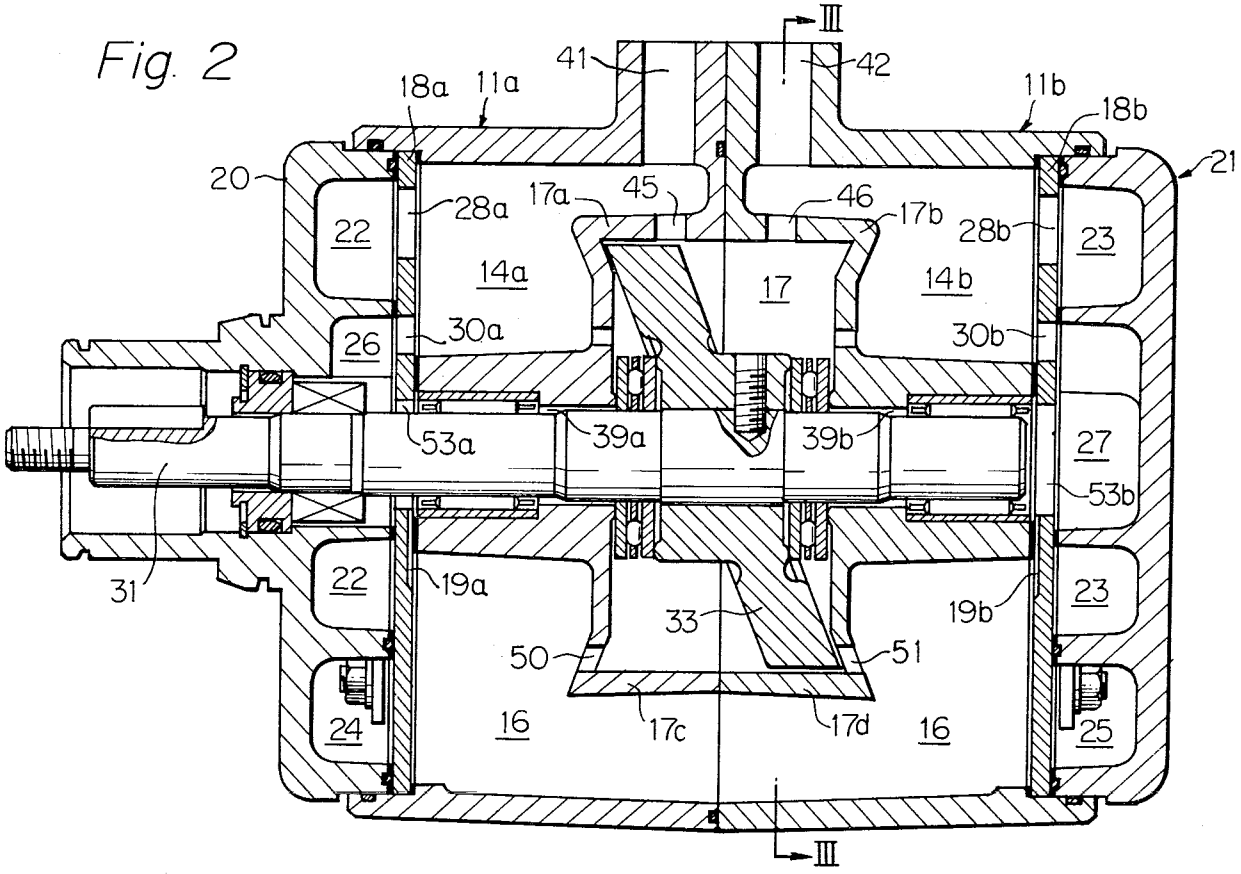
FIG. 2 is another longitudinal cross sectional view of the compressor of FIG. 1.
Figure 3:
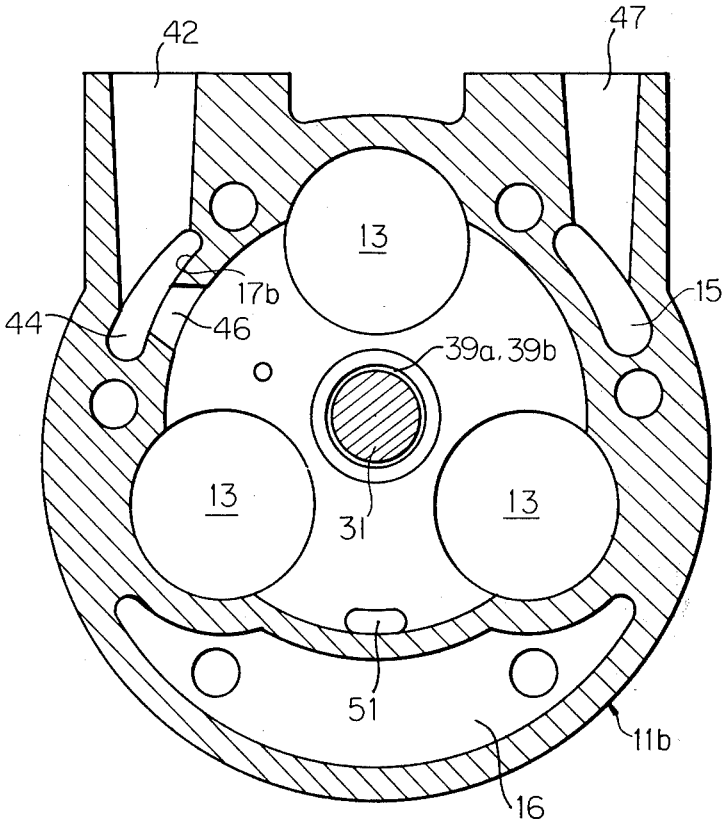
FIG. 3 is a vertical cross sectional view of one of the cylinder blocks of the compressor of FIG. 1, taken along the line III—III of FIG. 2.
Figure 4:
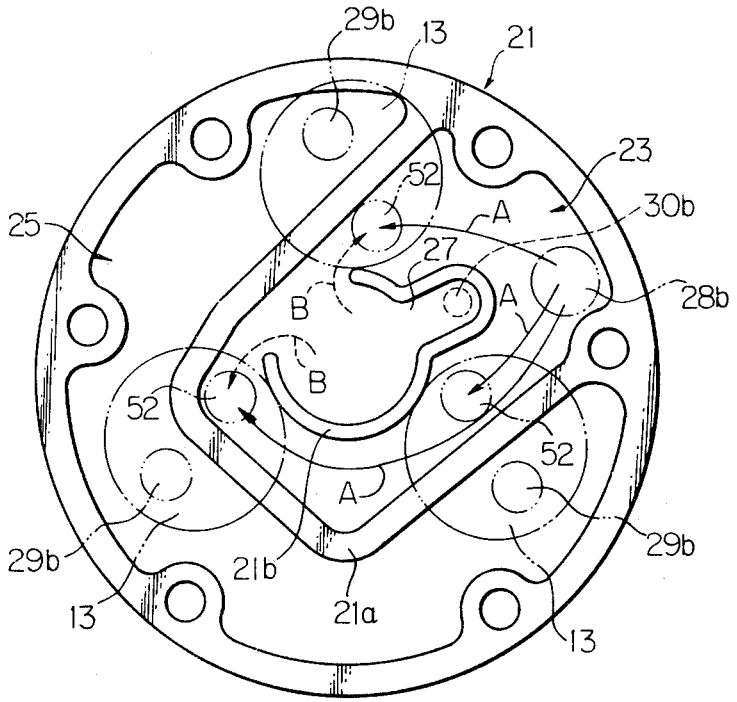
FIG. 4 is a front view of the rear cylinder head of the compressor of FIG. 1, illustrating an internal construction of the cylinder head.
Figure 5:
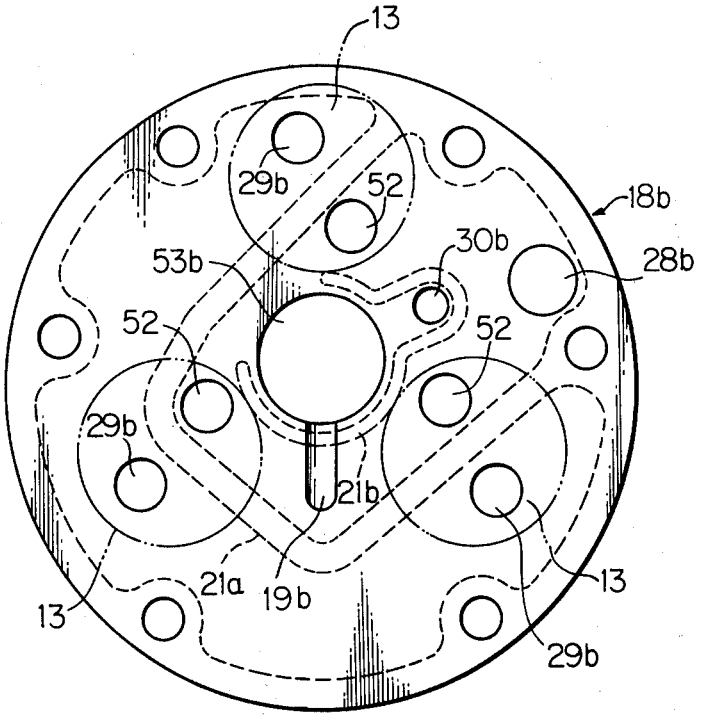
FIG. 5 is a front view of one of the valve plates employed for the compressor of FIG. 1.

Referring to FIGS. 1 through 5, the compressor has a pair of cylinder blocks, i.e. a front cylinder block 11*a* and a rear cylinder block 11*b*, combined with each other in an axial alignment. The combined block formed by the pair of cylinder blocks 11*a* and 11*b* is provided with three axially extending cylinder bores 13 arranged in parallel with each other, that is one upper cylinder bore and two lower cylinder bores. The combined blocks is also provided with a pair of oil separating sections 14*a* and 14*b*, discharging sections 15 for compressed refrigerant gas, a bottom oil reserving section 16, and a centrally arranged swash plate chamber 17. The respective sections 14*a*, 14*b*, 15 and 16 are formed in the spaces enclosed by the neighboring cylinder bores 13 and the outer wall of the combined block. The combined block is further accompanied by a pair of front and rear cylinder heads 20 and 21 attached to the front and rear cylinder blocks 11*a* and 11*b*, respectively, via respective valve plates 18 a and 18*b* and appropriate gaskets. The cylinder heads 20 and 21 are provided with, in their internal spaces, outer suction chambers 22 and 23, inner suction chambers 26 and 27, and exhaust chambers 24 and 25, respectively, which are defined by wall members 20*a*, 20*b*, 21*a*, and 21*b* projecting from internal end faces 48 and 49 of cylinder heads 20 and 21. As is apparent from FIG. 4, the outer and inner suction chambers are fluidly connected with each other, since each wall member 20*b* or 21*b* substantially formed in an annular shape has an opening for connection between outer and inner suction chambers. The valve plates 18*a*, 18*b* are provided with suction ports 28*a*, 28*b* connecting the oil separating sections 14*a*, 14*b* and the outer suction chambers 22, 23; respectively discharge ports (not shown) correcting the exhaust chambers 24, 25 and the discharge sections 15; suction apertures 52 correcting the outer suction chambers 22, 23 and the cylinder bores 13; exhaust ports 29*a*, 29*b* correcting the cylinder bores 13 and the exhaust chambers 24, 25; and oil ports 30*a*, 30*b* correcting the oil separating sections 14*a*, 14*b* and the inner suction chambers 26, 27, respectively. These ports and apertures of the valve plates 18*a* and 18*b* are constituted by through-holes as shown in FIG. 5. The valve plates 18*a* and 18*b* are also provided with recessed channels 19*a* and 19*b*, respectively described later, which are grooved on the inner end faces of the valve plates so as to downwardly extend from the lowermost part of the centrally positioned bores 53*a* and 53*b*. Coaxially passing through both cylinder blocks 11*a*, 11*b*, front cylinder head 20, and front valve plate 18*a*, a drive shaft 31 is rotatably supported by needle bearings 32 provided at axially outer ends of the combined block, and is provided with a swash plate 33 secured to the middle of said drive shaft 31. The swash plate 33 is operatively connected with, via ball bearings 35 and shoes 36, double acting mult-pistons 34 which are slidably fitted in the three cylinder bores 13 arranged in parallel with the drive shaft 31. Therefore, when the swash plate 33 is rotated by the drive shaft 31, the multi-piston reciprocate in the cylinder bores for effecting the compression action of the compressor. The axial loads produced by the reciprocating motions of the pistons 34 are borne by a pair of thrust bearings 37*a* and 37*b* arranged between end faces of the boss of the swash plate 33 and respective cylinder blocks 11*a* and 11*b*. The needle bearings 32 supporting the drive shaft 31 are supplied with oil lubricant through the previously mentioned bores 53*a* and 53*b* of the valve plates 18*a* and 18*b*, and inner suction chambers 26 and 27 of the cylinder heads 20 and 21. The oil lubricant supplied to the needle bearings 32 is further capable of lubricating the thrust bearings 37*a* and 37*b* after passing through annular clearances 39*a* and 39*b* which act as oil supply passageways formed between the cylinder blocks 11*a*, 11*b* and the drive shaft 31. The reference numeral 40 designates a sealing member provided in the front cylinder block 11*a*. As shown in FIGS. 1, 2 and 3, the cylinder blocks 11*a* and 11*b* are provided with a pair of inlet parts 41 and 42, which open at the outer walls 12*a* and 12*b* of said cylinder blocks in order to introduce the refrigerant gas and oil particles suspended in the gas, which are returned from the air-conditioning system of the vehicle, into the oil separating sections 14*a*, 14*b* of cylinder blocks 11*a* and 11*b*. However, as the inlet ports 41, 42 are formed so as to directly communicate with suction channels 43, 44 which are defined between the outer walls 12*a*, 12*b* of both cylinder blocks 11*a*, 11*b* and partition walls 17*a*, 17*b* of the swash plate chamber 17, and have relatively small vertically cross sectional areas, the returned refrigerant gas and oil particles are firstly introduced in the suction channels 43, 44 and subsequently led into the continuing oil separating sections 14*a*, 14*b* which have sector type vertical cross sections having areas larger than those of the suction channels 43, 44 respectively. The partition walls 17*a*, 17*b* of the swash plate chamber 17 are provided with through-holes 45, 46 for permitting a part of the oil particles suspended in the refrigerant gas introduced from the inlet ports 41, 42 to directly flow into the swash plate chamber 17 through said holes 45 and 46 due to the inertia of the stream of the refrigerant gas from the inlet ports 41 and 42. That is to say, the through-holes 45 and 46 are arranged to be nearly in alignment with inlet ports 41 and 42, respectively. The reference numeral 47 designates one of the outlet ports for enabling the compressed refrigerant gas, which is collected in the discharge sections 15 of the cylinder blocks 11*a* and 11*b* from the exhaust chambers 24, 25 of both cylinder heads 20, 21, to flow into the air-conditioning system of the vehicle. As shown in FIGS. 2 and 3, the swash plate chamber 17 is separated from the bottom oil reserving section 16 by lower partition walls 17*c* and 17*d* formed as one part of cylinder blocks 11*a* and 11*b*. The lower partition walls 17*c* and 17*d* are provided with outlet holes 50 and 51 through which the refrigerant gas and the oil particles in the swash plate chamber 17 can flow into the oil reserving section 16. It should be noted that the two outlet holes 50 and 51 may be replaced by a single outlet hole formed at the bottom face of the partition walls 17*c* and 17*d*. The refrigerant gas flowing out of the outlet holes 50 and 51 is introduced into the inner suction chambers 26, 27 of both cylinder heads 20, 21 after passing the oil reserving section 16 and the recessed channels 19*a*, 19*b* of the valve plates 18*a*, 18*b*. The refrigerant gas is then sucked together with the refrigerant gas which is introduced into the outer suction chambers 22, 23 after undergoing oil separation into cylinder bores 13 through suction apertures 52 so as to be compressed.

When the drive shaft 31 is driven, the compressor comes into operation for effecting compression of the refrigerant gas. During the operation of the compressor, the refrigerant gas together with the oil particles suspended in the gas, return from the air-conditioning system of the vehicle and rush into the suction channels 43, 44 of cylinder blocks 11*a* and 11*b* through inlet ports 41, 42. The major part of the refrigerant gas and oil particles then impinge upon the partition walls 17*a* and 17*b* of the swash plate chamber 17 and the flow is deflected in two opposed directions to the oil separating sections 14*a* and 14*b*, respectively. In the meantime, the remaining minor part of the refrigerant gas and the oil particles inertially flows into the swash plate chamber 17 through the through-holes 45 and 46 of the partition walls 17*a* and 17*b*, and the flow of the minor part impinges upon the rotating swash plate 33, so that the oil particles suspended in the refrigerant gas attach to or are splashed by the rotating swash plate. As a result, the oil particles wet the surface of the swash plate 33, ball bearings 35 and shoes 36 connecting the swash plate and the pistons 34, and thrust bearings 37*a*, 37*b*, so as to positively lubricate them. Since the swash plate chamber 17 is fluidly connected to the cylinder bores 13, it will be understood that the oil lubricant moved into the swash plate chamber 17 is also effective for lubricating the internal walls of the cylinder bores 13. The oil dropping down to the bottom of the swash plate chamber 17 enters into the bottom oil reserving section 16 through the holes 50 and 51 as described previously.

With respect to the previously described major part of the refrigerant gas and oil particles suspended in the gas, the oil particles are separated from the gas by the action of inertia when the flow is deflected into two opposed directions, and the separated oil flows towards the bottoms of the oil separating sections 14*a* and 14*b*. Further, the deflected flow of the refrigerant gas still containing oil particles comes into the oil separating sections 14*a*, 14*b* having larger cross sectional areas than the suction channels 43, 44, and as a result relatively heavy oil particles are then separated by gravity due to the retardation of the speed of the running flow. That is, the heavy oil particles fall down onto the bottom surface of the oil separating sections 14*a* and 14*b*. All of the separated oil in the front cylinder block 11*a* enters into the inner suction chamber 26 defined by wall member 20*b* through an oil port 30*a* of the valve plate 18*a*, and lubricates the seal member 40. The oil in the inner suction chamber 26 also wets the needle bearing 32 after passing through the bore 53*a*, and subsequently wets the thrust bearing 37*a* after passing through the oil supply channel 39*a*. In the case of rear cylinder block 11*b*, the entire portion of separated oil enters into the inner suction chamber 27 through an oil port 30*b* of the valve plate 18*b*, and lubricates the needle bearing 32 after passing through the bore 53*b* of the valve plate 18*b*. Subsequently, the oil also lubricates the thrust bearing 37*b* after passing through the oil supply channel 39*b*.

In the above embodiment of the present invention, the outer and inner suction chambers 22, 23, 26, 27 of front and rear cylinder heads 20 and 21 have a reduced internal pressure due to pumping of the pistons 34 during operation of the compressor. Therefore, the refrigerant gas flowing into the swash plate chamber 17 through the through-holes 45 and 46 are sucked into the inner suction chambers 26 and 27 via outlet holes 50 and 51 of the lower partition walls 17c and 17d, and the recessed channels 19a and 19b of the valve plates 18a and 18b. This refrigerant gas subsequently enters into cylinder bores 13 as shown by arrows "B" in FIG. 4, so that they are compressed in the cylinder bores 13. That is to say, it will be understood that during operation of the compressor, two refrigerant passageways in opposite directions are formed by the swash plate chamber 17, the outlet holes 50, 51, the bottom oil reserving sections 16, the recessed channels 19a, 19b, and the inner suction chambers 26, 27. These two refrigerant passageways are of course additional to the principal refrigerant passageways passing through the suction channels 43, 44, the oil separating sections 14a, 14b, and the outer suction chambers 22, 23. Arrows "A" in FIG. 4 show that the refrigerant gas passing through the principal refrigerant passageways, enters into the cylinder bores 13. It should be noted that the blow-by gas of high pressure, which leaks into the swash plate chamber 17 from the cylinder bores 13 during the compressing operation of the pistons 13, also flows through the outlet holes 50, 51, the bottom oil reserving section 16, and the recessed channels 19a, 19b, into the inner suction chambers 26, 27 so as to aid in forming the above-mentioned additional and novel refrigerant passageways. It should also be noted that the above-mentioned flow of the high pressure blow-by gas can be very effective for distributing the separated oil lubricant in the inner suction chambers 26, 27 to the cylinder bores, since the blow-by gas carriers the oil lubricant into the cylinder bores 13 when it enters into said bores.

As is explained in detail with reference to one embodiment of the present invention, and in accordance with the present invention, there is provided means for directly introducing a part of the oil particles suspended in the refrigerant gas which returns from the air-conditioning system of a vehicle, into the swash plate chamber. Thus, the oil component in the refrigerant gas can be directly supplied especially to the ball bearings and the shoes connecting the swash plate and the multi-pistons, thereby definitely preventing seizure of the compressor. It should be understood that the present invention is particularly effective for a compressor having no pumping element for distributing the oil lubricant. Further, it should be noted that the oil particles entering into the swash plate chamber can have a low temperature and be of high viscosity, since they are immediately introduced from the inlet ports 41 and 42, and the through-holes 45 and 46. As a result, the lubricating effect of the high viscosity oil lubricant is excellent.

Also, when the compressor stops, it should be understood that the recessed channels 19a, and 19b formed on the inner end faces of the valve plates 18a and 18b, and the wall member 20b and 21b of the cylinder heads 20 and 21 act as oil conduits guiding the separated oil in the oil separating sections 14a and 14b of the cylinder blocks into the botton oil reserving section 16 of the combined block.

Figure 6:
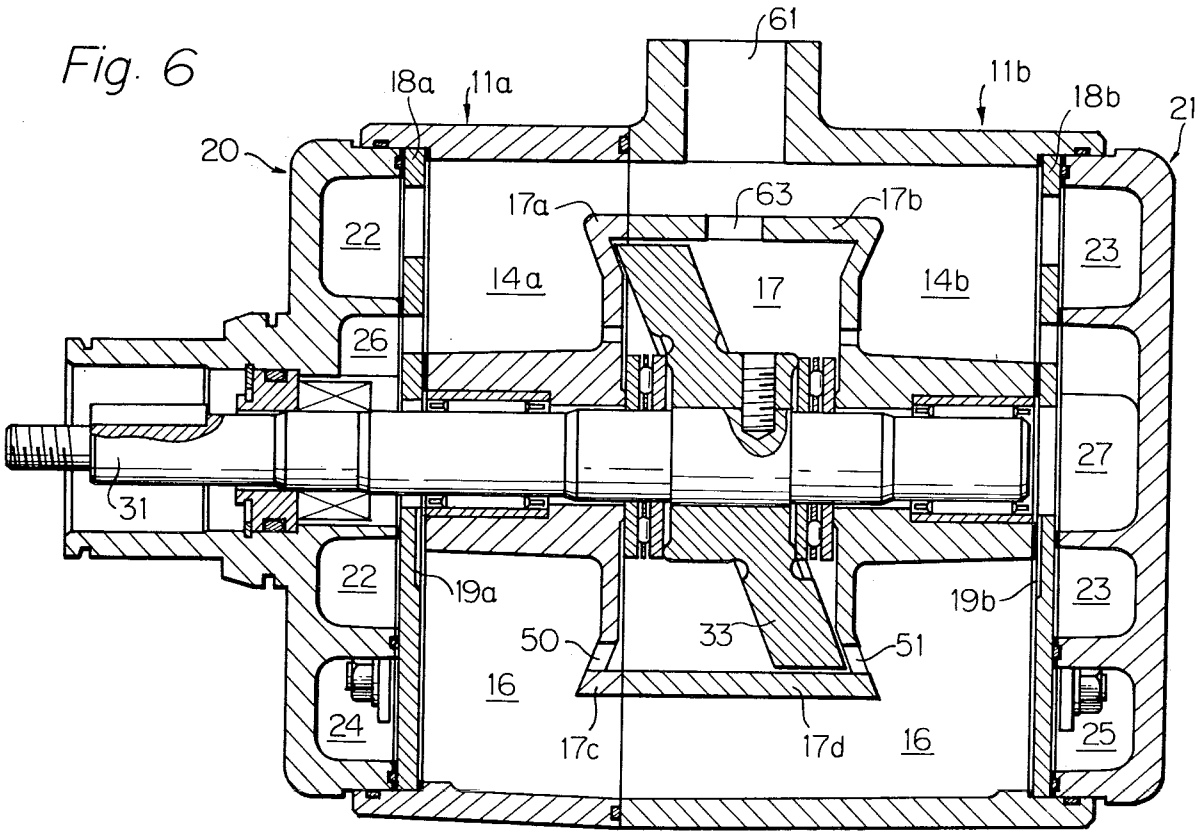
FIG. 6 is a longitudinal cross sectional view of a swash plate type compressor according to another embodiment of the present invention.
Figure 1:
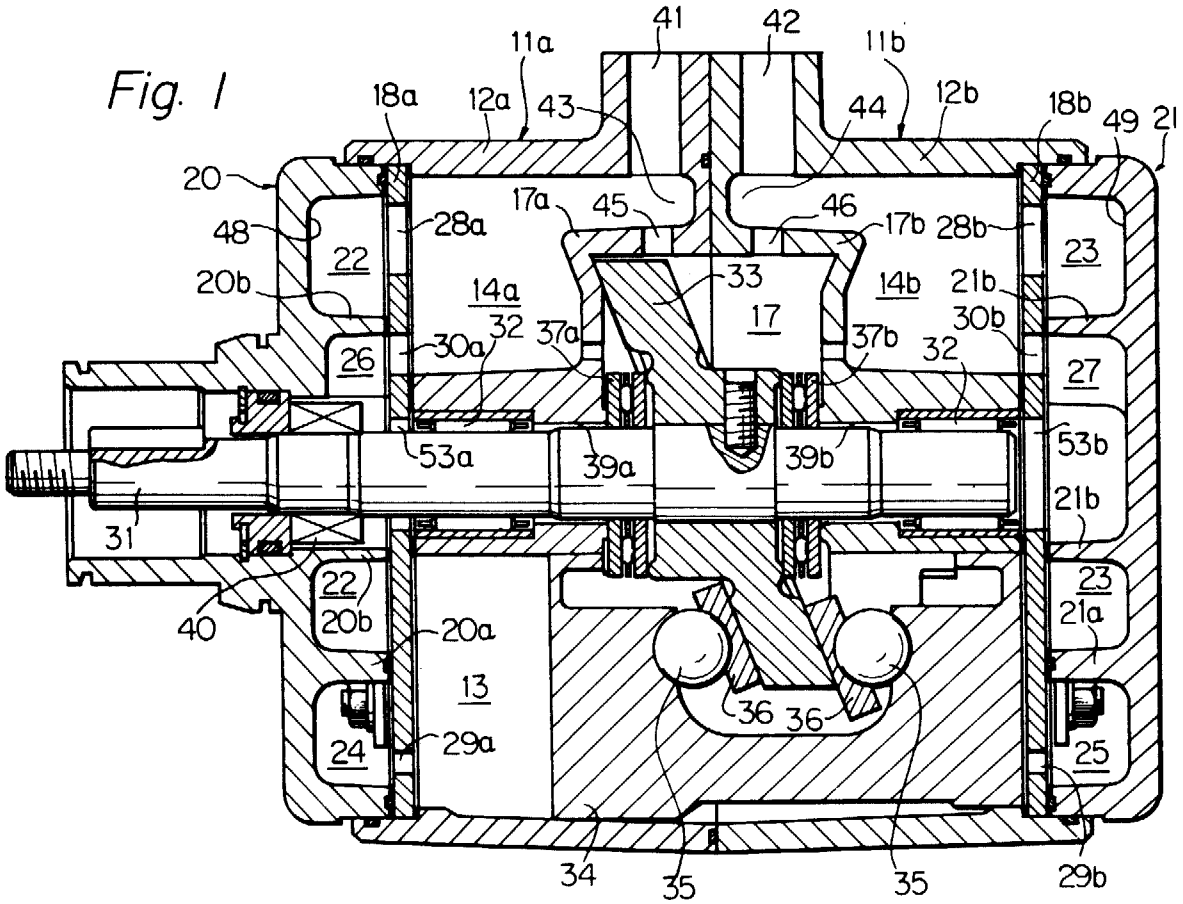

FIG. 6 shows another embodiment of the present invention. The compressor of this embodiment is different from the previous embodiment in that only a single inlet port 61 for introducing the refrigerant gas and the oil particles from the air-conditioning system of a vehicle into the compressor is provided, and also a single through-hole for directly introducing a part of the oil particles suspended in the returned refrigerant gas is formed in the partition wall of the swash plate chamber. Further, in the compressor of this embodiment, the oil separating sections 14a and 14b are fluidly connected to each other. The other portions are similar to the compressor of the previous embodiment, and therefore the same reference numerals are attached in FIG. 6. It will be easily understood that the embodiment of FIG. 6 exhibits the same advantageous lubricating effect as the embodiment of FIGS. 1 through 5 compared with the compressor of the known type.

In the foregoing description, the present invention is made apparent with reference to the two embodiments which are constructed on the basis of the swash plate type compressor of the type disclosed in the allowed United States patent application Ser. No. 188,897 now U.S. Pat. No. 3,801,227. However, it should be understood that the improvement of the present invention is similarly applicable to the compressor of the type disclosed in the U.S. Pat. No. 3,352,485.

What is claimed is:

1. A swash plate type compressor comprising: a pair of horizontal axially-aligned cylinder blocks forming a combined block having at least one inlet port for introducing a refrigerant gas together with oil particles suspended therein from the exterior of the compressor into the combined block, a plurality of oil separating passageways extending in opposite axial directions of the combined block and communicating with the inlet port for separating the oil particles from the introduced refrigerant gas; a swash plate chamber defined in the middle portion of said combined block, a drive shaft extending through said swash plate chamber, a swash plate in said swash plate chamber rotatably supported on said drive shaft, a plurality of compressor pistons and a plurality of cylinder bores in said combined block in which said compressor pistons are mounted on said swash plate causing reciprocal motion of compressor pistons retained in cylinder bores of said combined block; a pair of cylinder heads positioned at the ends of said combined block each said head having a suction chamber connected to each said oil separating passageway; valve plates interposed between said cylinder blocks; and an axially extending bottom chamber separated from said swash plate chamber by a lower partition wall provided at the bottom part of said combined block for receiving the separated oil particles, the improvement wherein the swash plate chamber is separated from said oil separating passageways by an upper partition wall provided in said combined block, a portion of said partition wall extending orthogonally with respect to the flow of oil and refrigerant through said inlet port in a position opposite said inlet port whereby the flow of oil and refrigerant makes a right angle bend along said partition wall, means located in the path of the refrigerant flowing from the inlet port to the oil passageways and proximate the portion of the partition wall where the oil and refrigerant make the right angle bend for drawing a flow of oil and refrigerant into said swash plate chamber containing a larger proportion of oil to refrigerant than said flow of oil and refrigerant passing into said combined block through said inlet port at a substantially centrally located portion of said swash plate chamber, said drawing means comprises a corresponding plurality of inlet through-holes formed in said upper partition wall, each inlet through-hole substantially being in alignment with said refrigerant gas inlet port and communicating with one of said separting passageways of said combined block thereby enabling the part of said oil particles suspended in said refrigerant gas to flow by inertia into said swash plate chamber, the oil particles entering said swash plate chamber thereby lubricating both sides of said swash plate, said swash plate chamber communicating with said suction chambers of said cylinder heads through through-outlet holes in said axially extending bottom chamber whereby said refrigerant gas introduced into said swash plate chamber through said drawing means is discharged toward said suction chambers during operation of the compressor, said outlet through-holes being oriented in a direction substantially parallel to said drive shaft and being spaced apart from said inlet through-holes with respect to the axis of said shaft.

2. A swash plate type compressor as claimed in claim 1, wherein recess channels are provided in said valve plates for communication between said bottom chamber and said suction chambers.

* * * * *

UNITED STATES PATENT OFFICE

CERTIFICATE OF CORRECTION

Patent No. 4,070,136 Dated January 24, 1978

Inventor(s) Shozo Nakayama, et al

It is certified that error appears in the above-identified patent and that said Letters Patent are hereby corrected as shown below:

Column 2, line 21: "blocks" should be --block--.

line 45: "respectively" should be before the semi-colon.

line 46: "correcting" should be --connecting--.

lines 47, 49 & 51: "correcting" should be --connecting--.

line 67: "mult-pistons" should be --multi-pistons--.

Column 3, line 3: "piston" should be --pistons--.

Column 7, line 3: "separting" should be --separating--.

Column 3, line 21: "parts" should be --ports--.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*

Patent No. 4,070,136 January 24, 1978

Shozo Nakayama et al.